US008662489B2

(12) United States Patent
Arai et al.

(10) Patent No.: US 8,662,489 B2
(45) Date of Patent: Mar. 4, 2014

(54) SHEET STACKING APPARATUS

(75) Inventors: Akihiro Arai, Toride (JP); Mitsuhiko Sato, Kashiwa (JP); Shunsuke Nishimura, Tokyo (JP); Toshiyuki Miyake, Abiko (JP); Takashi Yokoya, Kashiwa (JP); Hiromasa Maenishi, Matsudo (JP); Yutaka Ando, Toride (JP); Nozomi Kumakura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 13/553,584

(22) Filed: Jul. 19, 2012

(65) Prior Publication Data

US 2013/0038013 A1 Feb. 14, 2013

(30) Foreign Application Priority Data

Aug. 8, 2011 (JP) ..... 2011-172861

(51) Int. Cl.
*B65H 31/34* (2006.01)
*B65H 39/00* (2006.01)

(52) U.S. Cl.
USPC ..... 270/58.17; 270/58.07; 270/58.11; 270/58.12; 270/58.27

(58) Field of Classification Search
USPC ..... 270/58.07, 58.11, 58.12, 58.16, 58.17, 270/58.27; 271/220, 221
See application file for complete search history.

(56) References Cited

U.S. PATENT DOCUMENTS 6,832,759 B2 * 12/2004 Nagasako et al. ..... 271/222
7,300,052 B2 * 11/2007 Tamura et al. ..... 271/221
8,070,150 B2 * 12/2011 Tanaka et al. ..... 270/58.27

FOREIGN PATENT DOCUMENTS

JP 2006206331 A 8/2006

* cited by examiner

*Primary Examiner* — Leslie A Nicholson, III
(74) *Attorney, Agent, or Firm* — Canon USA, Inc., IP Division

(57) ABSTRACT

A sheet stacking apparatus includes a discharge unit, a stacking tray, an acquisition unit, a shift control unit, and an alignment unit. The shift control unit controls a stacking position of a sheet in a sheet width direction in response to shift information acquired by the acquisition unit. The alignment unit aligns a sheet staked on the stacking tray and moves to a position that abuts on a side edge of the sheet in the sheet width direction to align the sheet. The shift control unit controls a stacking position of a second sheet to stack the second sheet on a second position or on a first position depending on where a first sheet is stacked and on shift information of the second sheet.

8 Claims, 17 Drawing Sheets

FRONT SIDE VIEW

CROSS-SECTIONAL VIEW OF TRAY AT POSITION A

ALIGNMENT POSITION

RETRACTED POSITION

SHEET RETURN POSITION

RETRACTED POSITION

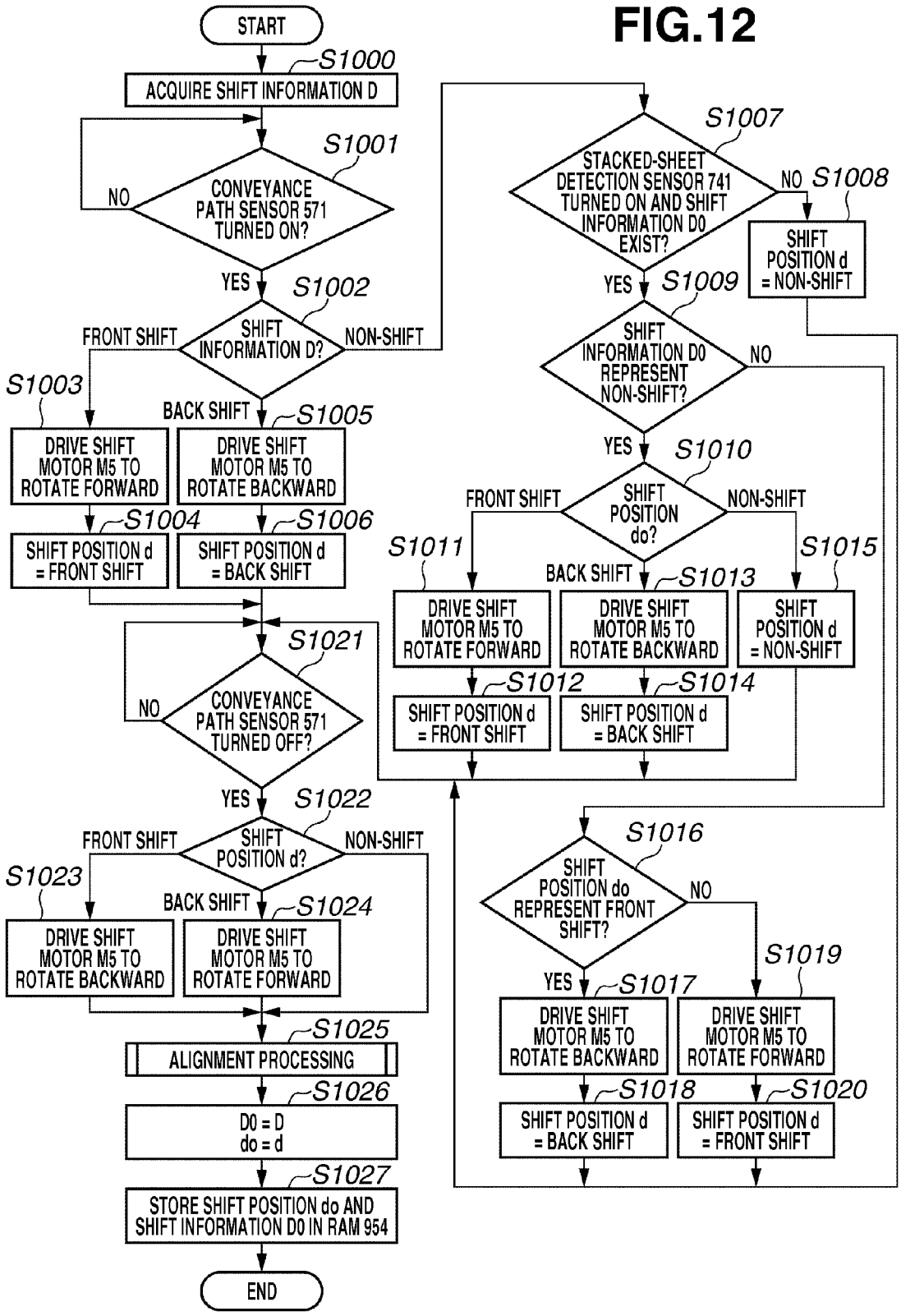
FIG.12
START
S1000
ACQUIRE SHIFT INFORMATION D
S1001
CONVEYANCE PATH SENSOR 571 TURNED ON?
NO
YES
S1002
SHIFT INFORMATION D?
FRONT SHIFT
NON-SHIFT
BACK SHIFT
S1003
DRIVE SHIFT MOTOR M5 TO ROTATE FORWARD
S1005
DRIVE SHIFT MOTOR M5 TO ROTATE BACKWARD
S1004
SHIFT POSITION d = FRONT SHIFT
S1006
SHIFT POSITION d = BACK SHIFT
S1021
CONVEYANCE PATH SENSOR 571 TURNED OFF?
NO
YES
S1022
SHIFT POSITION d?
FRONT SHIFT
NON-SHIFT
BACK SHIFT
S1023
DRIVE SHIFT MOTOR M5 TO ROTATE BACKWARD
S1024
DRIVE SHIFT MOTOR M5 TO ROTATE FORWARD
S1025
ALIGNMENT PROCESSING
S1026
D0 = D
do = d
S1027
STORE SHIFT POSITION do AND SHIFT INFORMATION D0 IN RAM 954
END
S1007
STACKED-SHEET DETECTION SENSOR 741 TURNED ON AND SHIFT INFORMATION D0 EXIST?
NO
S1008
SHIFT POSITION d = NON-SHIFT
YES
S1009
SHIFT INFORMATION D0 REPRESENT NON-SHIFT?
NO
YES
S1010
SHIFT POSITION do?
FRONT SHIFT
NON-SHIFT
BACK SHIFT
S1011
DRIVE SHIFT MOTOR M5 TO ROTATE FORWARD
S1013
DRIVE SHIFT MOTOR M5 TO ROTATE BACKWARD
S1015
SHIFT POSITION d = NON-SHIFT
S1012
SHIFT POSITION d = FRONT SHIFT
S1014
SHIFT POSITION d = BACK SHIFT
S1016
SHIFT POSITION do REPRESENT FRONT SHIFT?
NO
YES
S1017
DRIVE SHIFT MOTOR M5 TO ROTATE BACKWARD
S1019
DRIVE SHIFT MOTOR M5 TO ROTATE FORWARD
S1018
SHIFT POSITION d = BACK SHIFT
S1020
SHIFT POSITION d = FRONT SHIFT D: SHIFT INFORMATION OF CONVEYANCE SHEET
D0: SHIFT INFORMATION OF PRECEDING CONVEYANCE SHEET
do: SHIFT POSITION TO WHICH PRECEDING CONVEYANCE SHEET HAS ACTUALLY BEEN SHIFTED

FIG.15A

D = NON-SHIFT

| D0 \ do | FRONT SHIFT | BACK SHIFT | NON-SHIFT | UNKNOWN POSITION |
|---|---|---|---|---|
| FRONT SHIFT | BACK | | | |
| BACK SHIFT | | FRONT | | |
| NON-SHIFT | FRONT | BACK | NO | |
| NO INFORMATION | | | | NO |

FIG.15B

D = FRONT SHIFT

| D0 \ do | FRONT SHIFT | BACK SHIFT | NON-SHIFT | UNKNOWN POSITION |
|---|---|---|---|---|
| FRONT SHIFT | FRONT | | | |
| BACK SHIFT | | FRONT | | |
| NON-SHIFT | FRONT | FRONT | FRONT | |
| NO INFORMATION | | | | FRONT |

FIG.15C

D = BACK SHIFT

| D0 \ do | FRONT SHIFT | BACK SHIFT | NON-SHIFT | UNKNOWN POSITION |
|---|---|---|---|---|
| FRONT SHIFT | BACK | | | |
| BACK SHIFT | | BACK | | |
| NON-SHIFT | BACK | BACK | BACK | |
| NO INFORMATION | | | | BACK |

SHEET STACKING APPARATUS

BACKGROUND OF THE INVENTION

1. Field of the Invention

The present invention relates to a sheet stacking apparatus having a function of aligning a sheet on a stacking tray.

2. Description of the Related Art

Conventionally, there has been a system, in which a sheet post-processing apparatus is connected to an image forming apparatus downstream thereof in a sheet conveyance direction, for performing post-processing such as staking processing, stapling processing, and punching processing.

In the above-described system, a sheet, on which an image is formed by the image forming apparatus, is conveyed and stacked onto a sheet discharge tray in the sheet post-processing apparatus. A user may perform post-processing on the sheet stacked on the sheet discharge tray using an offline apparatus, or may directly pack the sheet as a product in a box. Therefore, the sheet post-processing apparatus that stacks the sheet onto the sheet discharge tray has required high-precision alignment and sorting properties.

In response to the above-described request, Japanese Patent Application Laid-Open No. 2006-206331 discusses a configuration in which an alignment member is provided on a sheet discharge tray in an apparatus capable of sorting and stacking (hereinafter referred to as shift stacking) a sheet, and the alignment member abuts on an edge of the sheet parallel to a sheet discharge direction to align a position of the edge of the sheet, and stacks the sheet.

Conventionally, a user selects whether a plurality of sheet bundles formed by an image forming system is shift stacked or non-shift stacked according to how the sheet bundles will be processed later.

However, in the configuration discussed in Japanese Patent Application Laid-Open No. 2006-206331 and when shift stacking is not selected, the following issue occurs in an apparatus having a configuration in which a sheet is stacked at the center of a stacking tray. As illustrated in FIG. 11, when a sheet, which is not designated to be shift stacked, is newly stacked and aligned with sheet bundles shift stacked on a sheet discharge tray, an alignment plate 711*a* or 711*b*, which contacts the sheet moves to rub already stacked sheets. As a result, the already stacked sheets, which have been shift stacked, may be damaged by scratches or dirt.

SUMMARY OF THE INVENTION

The present invention is directed to a sheet stacking apparatus that can prevent a sheet, which is shift stacked on a stacking tray, from being damaged.

According to an aspect of the present invention, a sheet stacking apparatus includes a discharge unit configured to discharge a sheet to be conveyed, a stacking tray configured to stack the sheet discharged by the discharge unit, an acquisition unit configured to acquire shift information for designating a stacking position of the sheet in a sheet width direction which is orthogonal to a sheet conveyance direction to sort a set of a copy, a shift control unit configured to control, in response to the shift information acquired by the acquisition unit representing stacking in a first position, the stacking position of the sheet in the sheet width direction so that the sheet is stacked in the first position, to control, in response to the shift information representing stacking in a second position, the stacking position of the sheet in the sheet width direction so that the sheet is stacked in the second position, and to control, in response to the shift information representing neither the first position nor the second position and the sheet not being stacked on the stacking tray, the stacking position of the sheet in the sheet width direction so that the sheet is stacked in a third position between the first position and the second position, and an alignment unit configured to align the sheet staked on the stacking tray, wherein the alignment unit moves to a position corresponding to the stacking position of the sheet controlled by the shift control unit and abuts on a side edge of the sheet in the sheet width direction to align the sheet, wherein, in response to a first sheet being stacked on the first position and shift information of a second sheet, which is subsequent to the first sheet, not indicating either the first position or the second position, the shift control unit controls a stacking position of the second sheet to stack the second sheet on the second position, and, in response to the first sheet being stacked on the second position and the shift information of the second sheet not indicating either the first position or the second position, the shift control unit controls the stacking position of the second sheet to stack the second sheet on the first position.

Further features and aspects of the present invention will become apparent from the following detailed description of exemplary embodiments with reference to the attached drawings.

BRIEF DESCRIPTION OF THE DRAWINGS

The accompanying drawings, which are captured in and constitute a part of the specification, illustrate exemplary embodiments, features, and aspects of the invention and, together with the description, serve to explain the principles of the invention.

FIG. 12 is a flowchart illustrating a shift operation.

FIGS. 15A to 15C are tables indicating correspondence relationships between shift positions of preceding sheets and shift positions of subsequent sheets.

DESCRIPTION OF THE EMBODIMENTS

Various exemplary embodiments, features, and aspects of the invention will be described in detail below with reference to the drawings.

Figure 1:
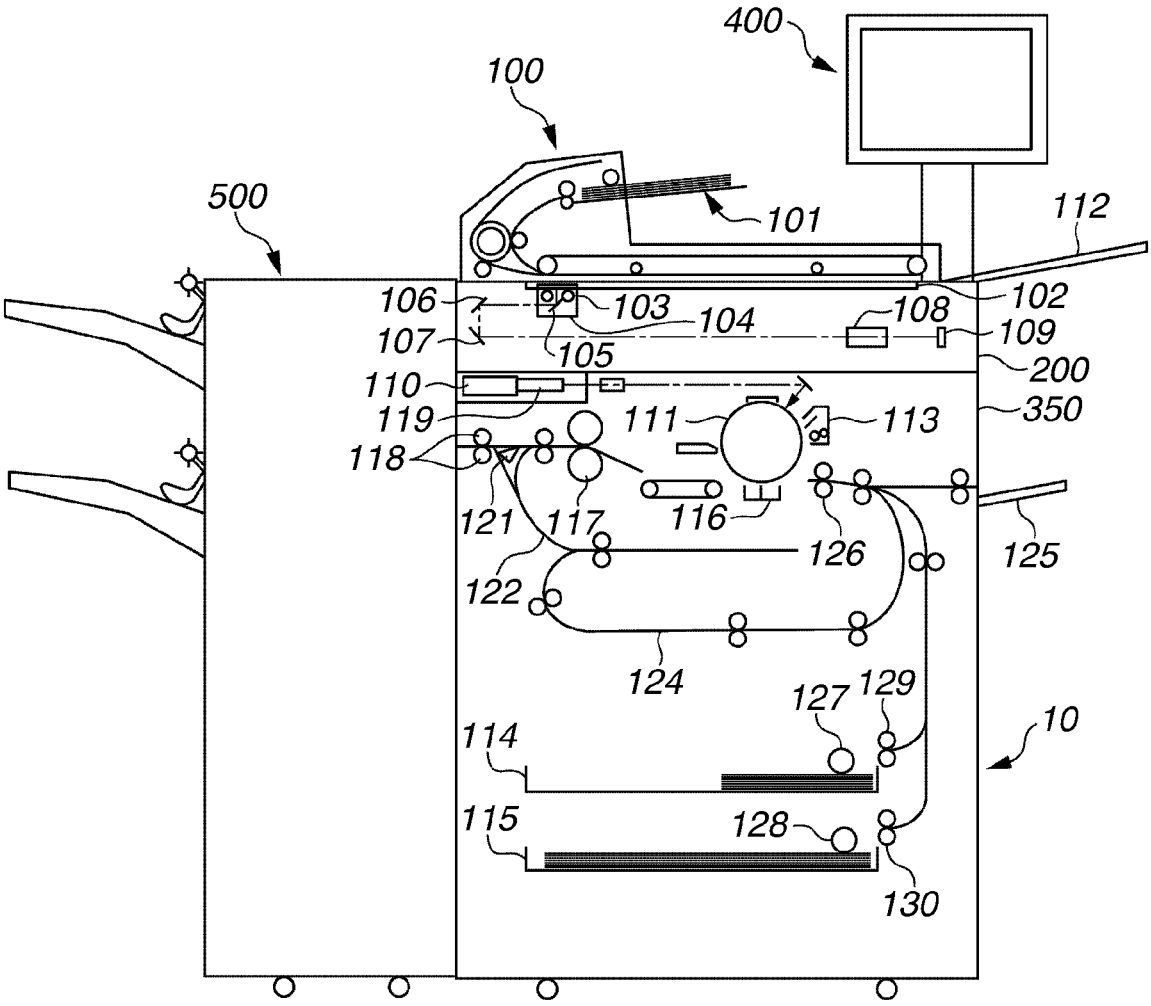
FIG. 1 illustrates an overall configuration of an image forming system.

FIG. 1 is a cross-section view illustrating a configuration of a principal part of an image forming system according to a first exemplary embodiment. The image forming system includes an image forming apparatus 10 and a finisher 500 serving as a sheet stacking apparatus. The image forming apparatus 10 is equipped with an image reader 200 configured to read an image from a document, and a printer 350 configured to form the read image on a sheet.

A document feeding apparatus 100 feeds the document set with its surface facing up on a document tray 101 one by one from the first page, conveys the document to a predetermined reading position on a platen glass 102, and then discharges the document onto a discharge tray 112. At this time, a scanner unit 104 is fixed to a predetermined reading position. When the document passes through the reading position, the scanner unit 104 reads a document image. More specifically, when the document passes through the reading position, the document is irradiated with light from a lamp 103 in the scanner unit 104, and the light reflected from the document is guided to a lens 108 via mirrors 105, 106, and 107. The light, which has passed through the lens 108, forms an image on an imaging plane of an image sensor 109. The image sensor 109 converts the image into image data, and outputs the image data. The image data output from the image sensor 109 is input as a video signal to an exposure unit 110 in the printer 350.

The exposure unit 110 in the printer 350 modulates a laser beam based on the video signal input from the image reader 200 and outputs the modulated laser beam. The laser beam is irradiated onto a photosensitive drum 111 while being scanned by a polygonal mirror 110*a*. An electrostatic latent image corresponding to the scanned laser beam is formed on the photosensitive drum 111. The electrostatic latent image on the photosensitive drum 111 is visualized as a developer image by a developer supplied from a development device 113.

A sheet is fed from an upper cassette 114 or a lower cassette 115 installed within the printer 350 by a pickup roller 127 or 128. The fed sheet is conveyed to registration rollers 126 by sheet feeding rollers 129 or sheet feeding rollers 130. When a leading edge of the sheet reaches the registration rollers 126, the registration rollers 126 are driven with a predetermined timing, and the sheet is conveyed to a gap between the photosensitive drum 111 and a transfer unit 116.

The transfer unit 116 transfers the developer image formed on the photosensitive drum 111 onto the fed sheet. The sheet, on which the developer image has been transferred, is conveyed to a fixing unit 117. The fixing unit 117 applies heat and pressure to the sheet to fix the developer image onto the sheet. The sheet passed through the fixing unit 117 is discharged from the printer 350 toward the outside of the image forming apparatus 10 (the finisher 500) via a flapper 121 and discharge rollers 118. When image formation is performed on both sides of the sheet, the sheet is conveyed to a two-sided conveyance path 124 via a reversing path 122 and is further conveyed to the registration rollers 126 again.

Figure 2:
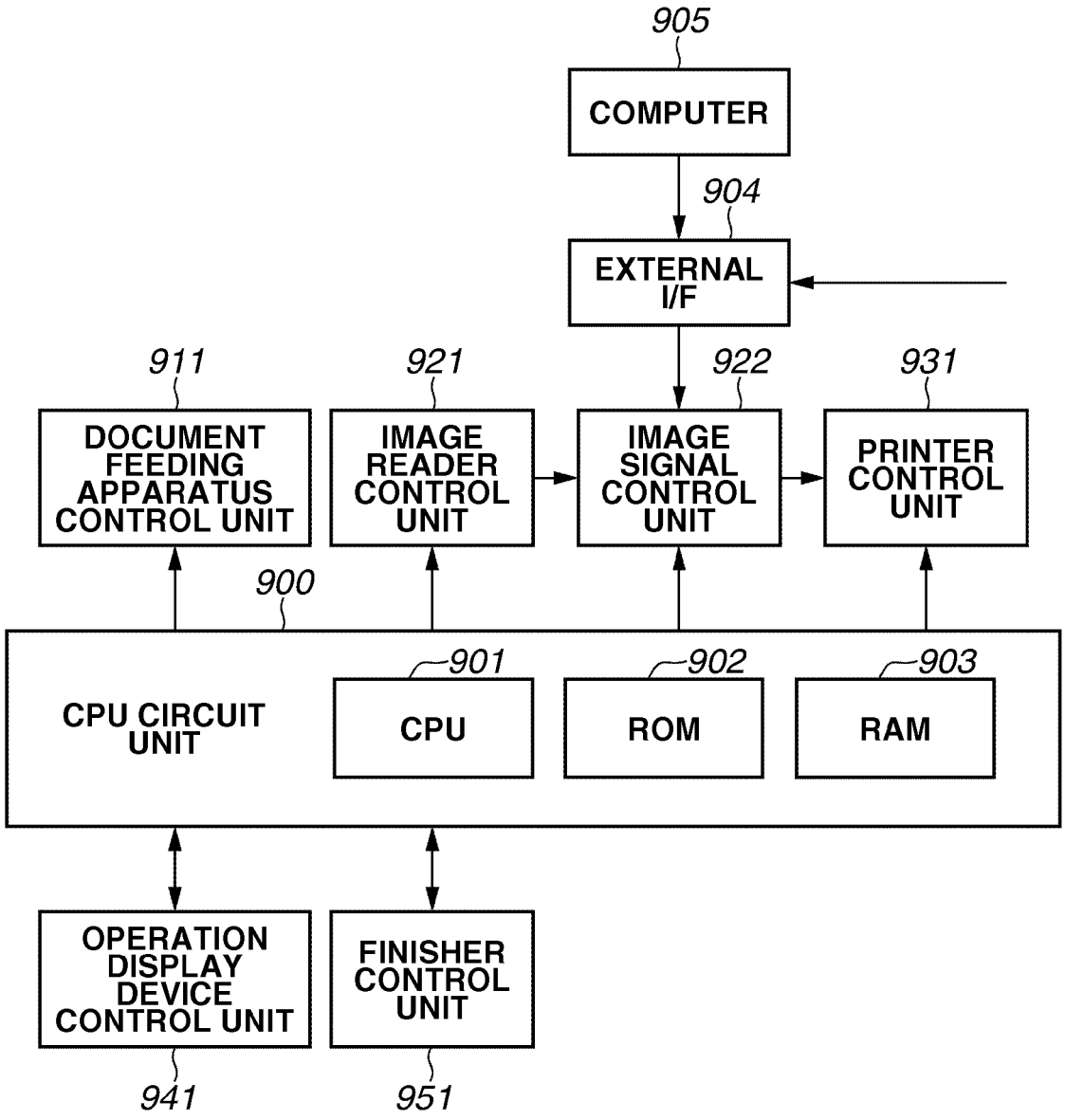
FIG. 2 is a block diagram illustrating a configuration of a controller.

A configuration of a controller that controls the whole image forming system illustrated in FIG. 1 and a block diagram of an overall system configuration will be described with reference to FIG. 2. FIG. 2 is the block diagram illustrating the configuration of the controller that controls the whole image forming system in FIG. 1.

As illustrated in FIG. 2, the controller includes a central processing unit (CPU) circuit unit 900, and the CPU circuit unit 900 contains a CPU 901, a read-only memory (ROM) 902, and a random-access memory (RAM) 903. The CPU 901 is a CPU for performing the basic control of the entire present image forming system. The ROM 902 to which a control program is written and the RAM for performing the processing are connected to the CPU 901 by an address bus and a data bus. The CPU 901 collectively controls various types of control units 911, 921, 922, 904, 931, 941, and 951 by the control program stored in the ROM 902. The RAM 903 temporarily stores the control data and is used as an operation area for a computation processing involved in the control.

The document feeding apparatus control unit 911 performs drive control of the document feeding apparatus 100 based on an instruction from the CPU circuit unit 900. The image reader control unit 921 performs drive control of the scanner unit 104, the image sensor 109, and the like, and transfers an image signal output from the image sensor 109 to the image signal control unit 922.

The image signal control unit 922 converts an analog image signal from the image sensor 109 into a digital signal and performs various processing on the digital signal. The image signal control unit 922 further converts the digital signal into a video signal and outputs the video signal to the printer control unit 931. Further, the image signal control unit 922 performs various types of processing on a digital image signal input from the computer 905 via an external interface (I/F) 904, and converts the digital image signal to a video signal to output it to the printer control unit 931. The CPU circuit unit 900 controls a processing operation performed by the image signal control unit 922.

The printer control unit 931 controls the exposure unit 110 and the printer 350 based on the input video signal, to perform image formation and sheet conveyance. The finisher control unit 951 is loaded into the finisher 500, and exchanges information with the CPU circuit unit 900 to perform drive control of the whole finisher 500. A content of the control will be described in detail below. The operation display device control unit 941 exchanges information between an operation display device 400 and the CPU circuit unit 900.

The operation display device 400 includes a plurality of keys for setting various functions relating to image formation, a display unit for displaying information representing a setting state, and the like. The operation display device 400 outputs a key signal corresponding to an operation of each of the keys to the CPU circuit unit 900, and displays corresponding information based on the signal from the CPU circuit unit 900.

Figure 3:
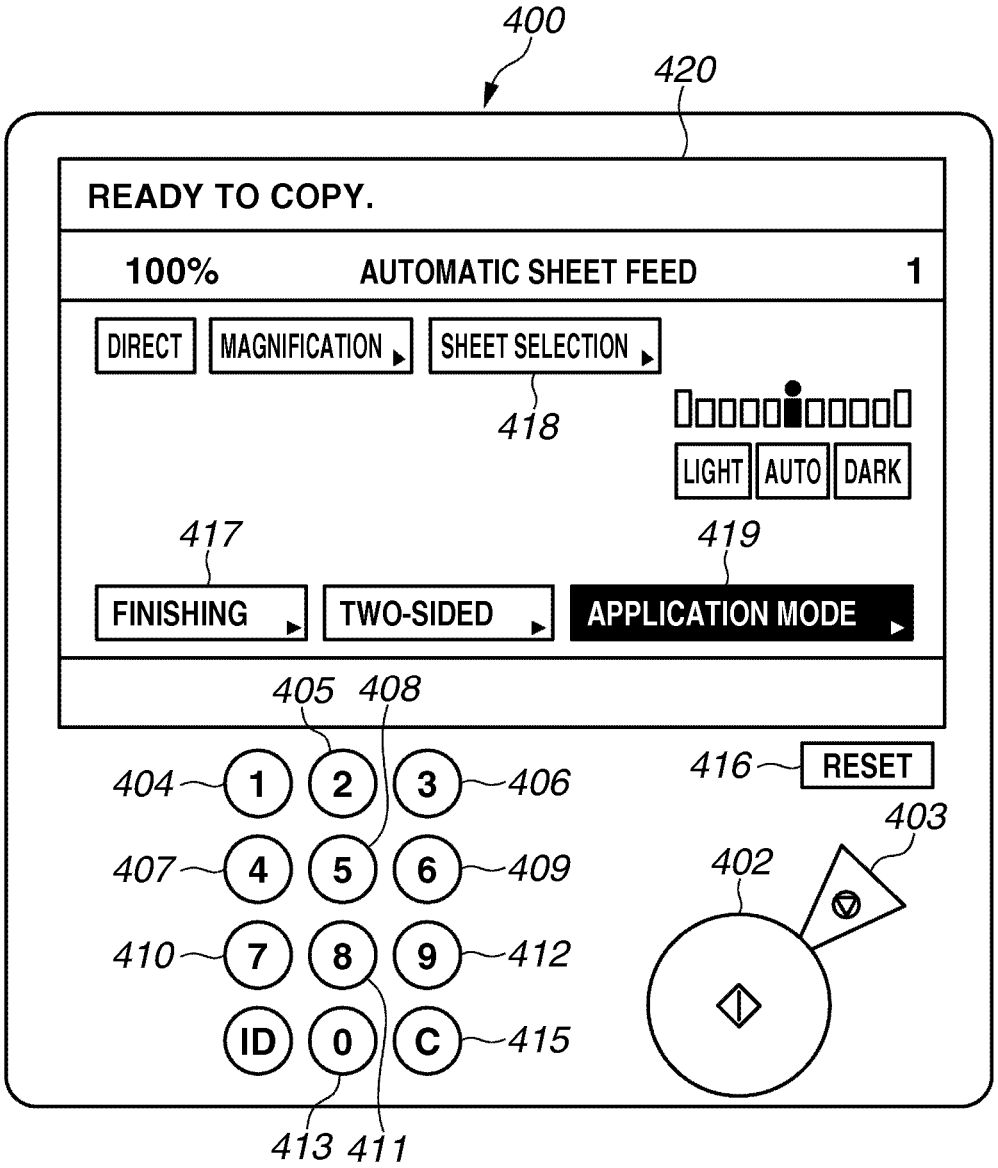
FIG. 3 illustrates an operation display device.

FIG. 3 illustrates the operation display device 400 in the image forming apparatus 10 illustrated in FIG. 1. The operation display device 400 includes a start key 402 for starting an image forming operation, a stop key 403 for interrupting the image forming operation, numeric keypads 404 to 413 for performing register setting and others, a clear key 415, a reset key 416, and so on. The operation display device 400 includes a display unit 420 having a touch panel formed on its surface, and can generate a soft key on its screen.

The image forming apparatus 10 has various processing modes, such as a non-sort mode, a sort mode, a shift sort mode, and a staple sort mode (a binding mode) as post-processing modes. Such a processing mode is set by an input operation from the operation display device 400. If the post-processing mode is set, for example, when a "finishing" key 417 is selected on the initial screen illustrated in FIG. 3, a menu selection screen is displayed on the display unit 420. The processing mode is set using the menu selection screen.

Figure 4A:
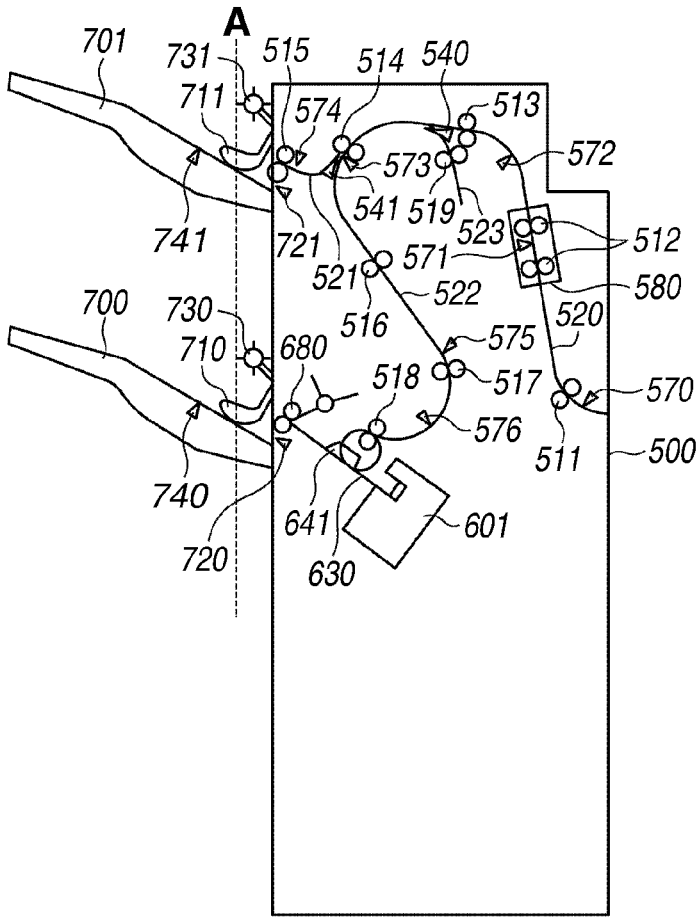
FIGS. 4A and 4B illustrate a finisher.
Figure 4B:
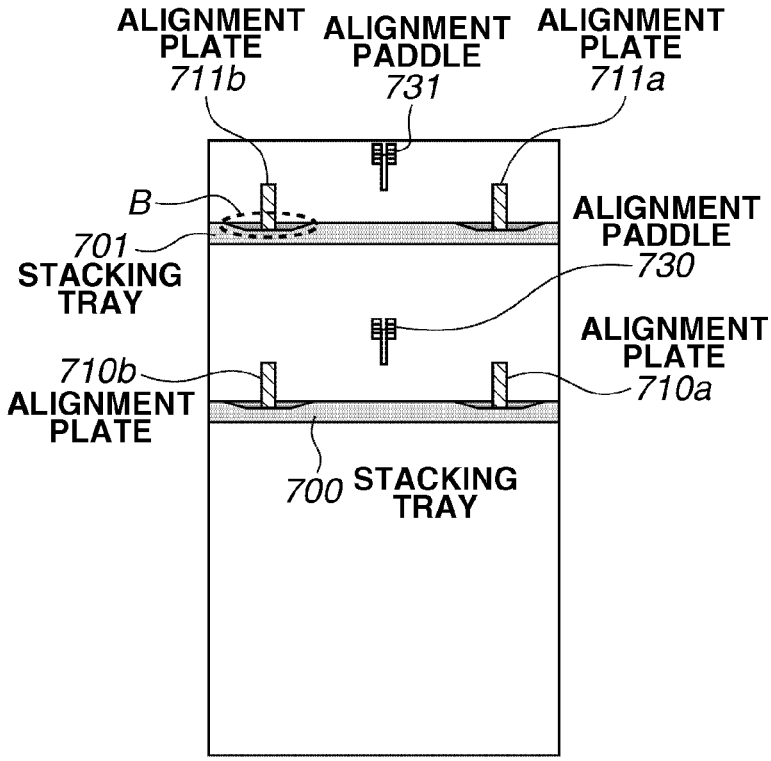

A configuration of the finisher 500 illustrated in FIG. 1 will be described below with reference to FIGS. 4A and 4B. FIG. 4A illustrates the finisher 500 as viewed from the front, and FIG. 4B is a cross-sectional view illustrating a cross section at a position A of a stacking tray 701 in the finisher 500 as viewed from a sheet discharge direction.

The finisher 500 performs various types of sheet post-processing, such as processing for sequentially receiving sheets discharged from the image forming apparatus 10, aligning and binding a plurality of the received sheets into one bundle, and stapling a trailing edge of the bundle. The finisher 500 takes the sheet discharged from the image forming apparatus 10 into a conveyance path 520 using a conveyance roller pair 511. The sheet taken by the conveyance roller pair 511 is conveyed via conveyance roller pairs 512, 513, and 514. Conveyance path sensors 570, 571, 572, and 573 are provided on the conveyance path 520, and each detect the passage of the sheet.

The conveyance roller pair 512, together with the conveyance path sensor 571, is provided in a shift unit 580. The shift unit 580 can move the sheet in a sheet width direction, which is orthogonal to the sheet conveyance direction, by a shift motor M5 described below. When the shift motor M5 is driven in a state in which the conveyance roller pair 512 pinches the sheet, the sheet can be offset in the sheet width direction while being conveyed.

In the shift sort mode, a position of a sheet bundle is shifted in the sheet width direction for each set of a copy. An offset amount is 15 mm toward the front (a front shift) or 15 mm toward the back (a back shift) from a center position in the sheet width direction If a shift is not designated, the sheet is discharged onto the same position as that in the front shift. The finisher 500 drives the shift motor M5 when it detects that the sheet has passed through the shift unit 580 according to an input of the conveyance path sensor 571, and returns the shift unit 580 to a center position.

A switching flapper 540 for guiding the sheet, which is reversed and conveyed by the conveyance roller pair 514, into a buffer bus 523 is arranged between the conveyance roller pairs 513 and 514. A solenoid SL1, described below, drives the switching flapper 540. A switching flapper 541 for switching between an upper sheet discharge path 521 and a lower sheet discharge path 522 to which the sheet is to be conveyed is arranged between the conveyance roller pairs 514 and 515. A solenoid SL2, described below, drives the switching flapper 541.

When the switching flapper 541 is switched toward the upper sheet discharge path 521, the conveyance roller pair 514, which is driven by a buffer motor M2, guides the sheet to the upper sheet discharge path 521, and the conveyance roller pair 515, which is driven by a sheet discharge motor M3, discharges the sheet onto the stacking tray 701. A conveyance path sensor 574 serving as a sheet detection unit is provided on the upper sheet discharge path 521 to detect the passage of the sheet.

When the switching flapper 541 is switched toward the lower sheet discharge path 522, the conveyance roller pair 514, which is driven by the buffer motor M2, guides the sheet to the lower sheet discharge path 522. Conveyance roller pairs 517 and 518, which are driven by the sheet discharge motor M3, further guide the sheet to a processing tray 630. Conveyance path sensors 575 and 576 are provided on the lower sheet discharge path 522 to detect the passage of the sheet.

A bundle discharge roller pair 680, which is driven by a bundle discharge motor M4, discharges the sheet guided to the processing tray 630 onto the processing tray 630 or a stacking tray 700 according to the post-processing mode.

In addition, as illustrated in FIG. 4B, alignment plates 711*a* and 711*b* and an alignment paddle 731 are arranged on the stacking tray 701. The alignment plates 711*a* and 711*b* align a position in the sheet width direction of the sheet discharged onto the stacking tray 701 by abutting on a side edge of the sheet. The alignment paddle 731 conveys the discharged sheet downward in the sheet discharge direction. Similarly, alignment plates 710*a* and 710*b* and an alignment paddle 730 are arranged on the stacking tray 700, as illustrated in FIG. 4B. The alignment plates 710*a* and 710*b* align a position in the sheet width direction of the sheet discharged onto the stacking tray 700. The alignment paddle 730 conveys the discharged sheet downward in the sheet discharge direction. The alignment paddles 731 and 730 are respectively arranged at conveyance center positions in the sheet width direction on the stacking trays 701 and 700. Therefore, a conveyance orientation taken by the alignment paddle when the center of the sheet in the sheet width direction matches a position of the alignment paddle is more stable than that taken when the sheet is offset from the center and is discharged.

The stacking trays 700 and 701 are respectively provided with dents for improving alignment of the sheets by the alignment plates 710 and 711 in the vicinities of alignment positions of the alignment plates 710 and 711, as indicated by broken lines B in FIG. 4B.

Figure 6A:
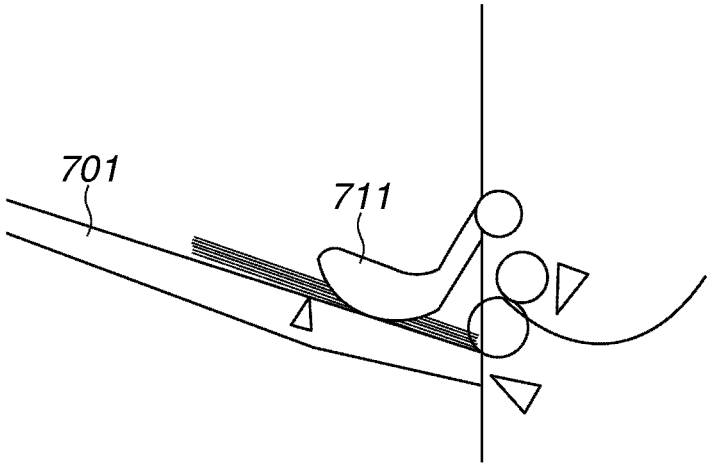
FIGS. 6A and 6B illustrate elevating operation positions of an alignment plate.
Figure 6B:
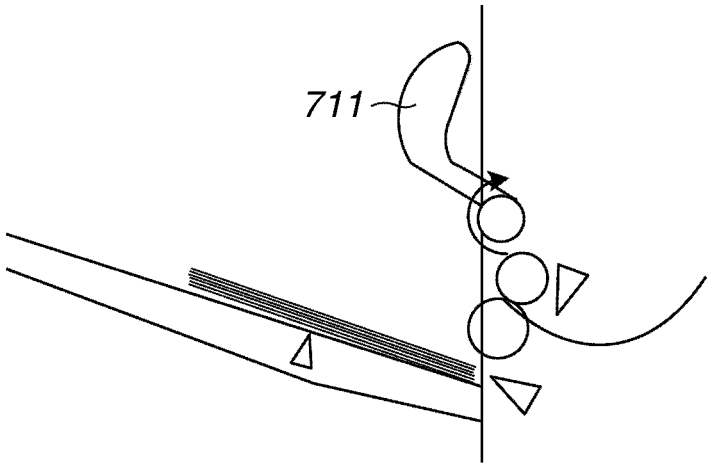

The alignment plates 710*a* and 710*b* are movable in the sheet width direction, respectively, by lower tray alignment motors M10 and M11, described below. The alignment plate 710*a* and the alignment plate 710*b* are respectively arranged on the front side and the back side. Similarly, upper tray alignment motors M8 and M9 respectively drive the alignment plates 711*a* and 711*b*. The alignment plate 711*a* and the alignment plate 711*b* are respectively arranged on the front side and the back side. An upper tray alignment plate elevating motor M12 and a lower tray alignment plate elevating motor M13, which are described below, respectively move the alignment plates 710 and 711 up and down around alignment plate shafts 712 between an alignment position (FIG. 6A) and a retracted position (FIG. 6B).

Figure 7A:
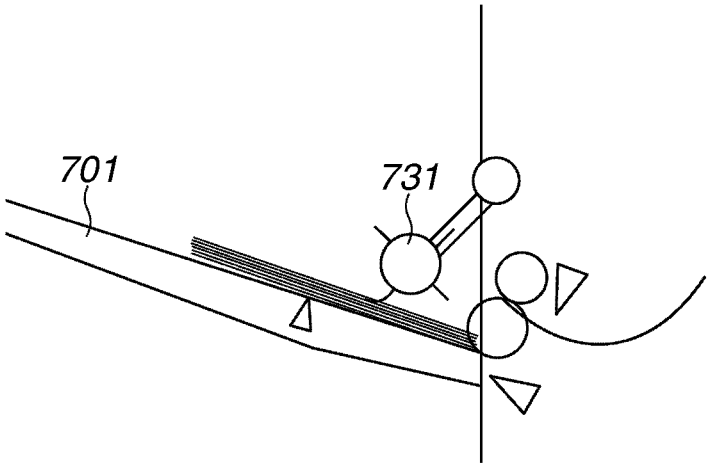
FIGS. 7A and 7B illustrate elevating operation positions of an alignment paddle.
Figure 7B:
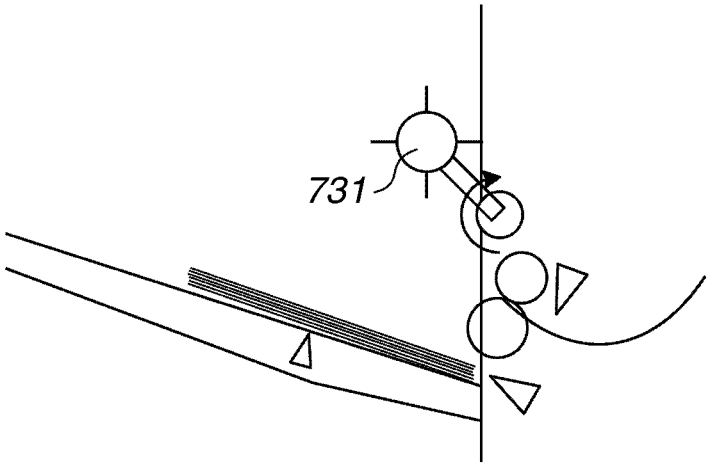

An upper tray paddle motor M17 and a lower tray paddle motor M18, which are described below, respectively drive the alignment paddles 731 and 730 to rotate to return the discharged sheets toward the upstream side in the sheet discharge direction. Further, the alignment paddles 731 and 730 respectively rotate around shafts, so that their positions are changed between a sheet return position (FIG. 7A) and a retracted position (FIG. 7B).

Tray elevating motors M14 and M15, described below, can respectively elevate the stacking trays 700 and 701. Sheet surface detection sensors 720 and 721, which are described below, detect the stacking trays 700 and 701 or uppermost surfaces of the sheets on the trays. The finisher 500 drives the tray elevating motors M14 and M15 respectively, in response to inputs from the sheet surface detection sensors 720 and 721 to perform control so that the stacking trays 700 and 701 or the uppermost surfaces of the sheets on the trays, described above, are at predetermined positions. Stacked-sheet detection sensors 740 and 741 respectively detect the presence or absence of the sheets on the stacking trays 700 and 701.

Figure 5:
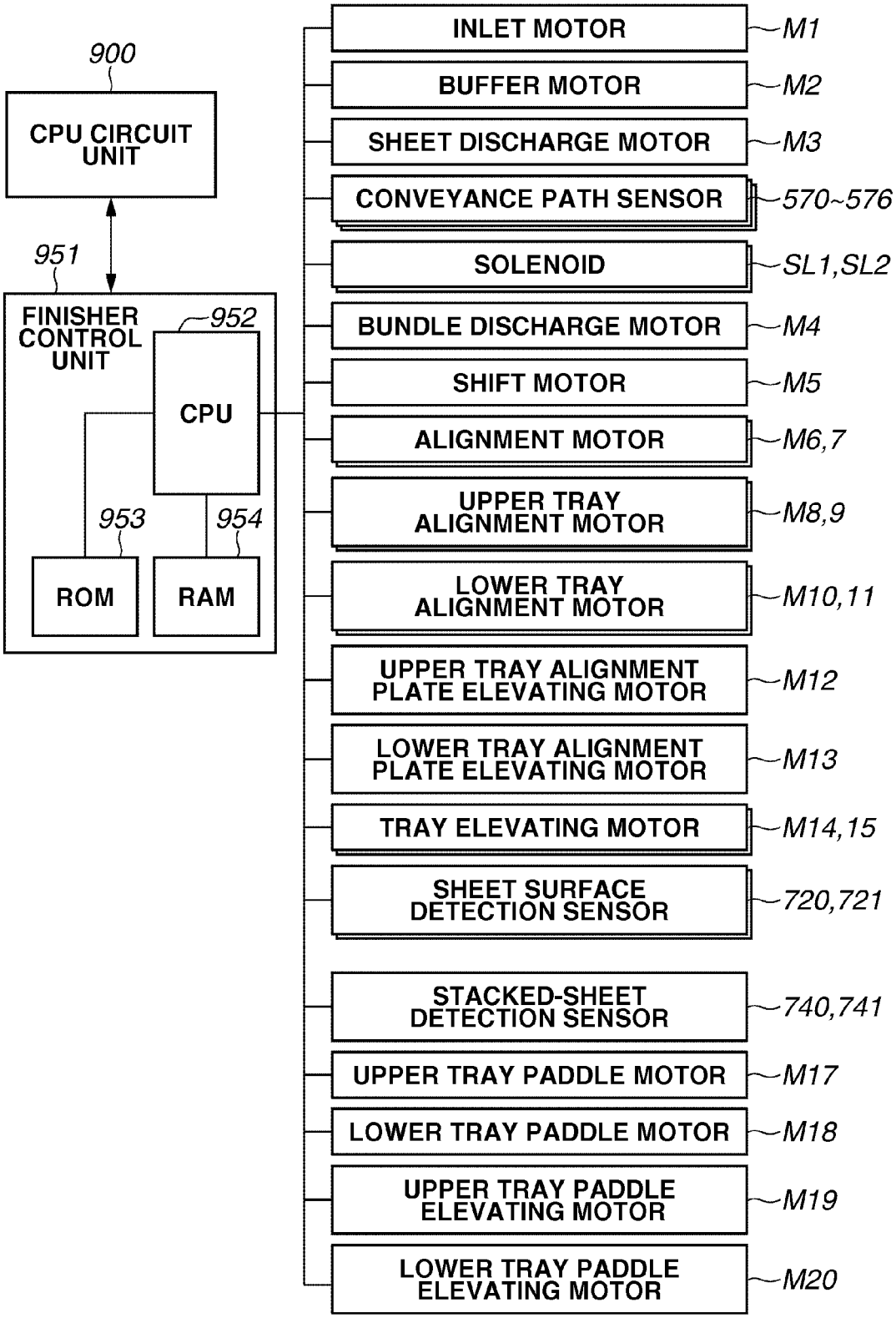
FIG. 5 is a block diagram of the finisher.

A configuration of the finisher control unit 951 that performs drive control of the finisher 500 will be described below with reference to FIG. 5. FIG. 5 is a block diagram illustrating the configuration of the finisher control unit 951 illustrated in FIG. 2.

The finisher control unit 951 includes a CPU 952, a ROM 953, and a RAM 954, as illustrated in FIG. 5. The finisher control unit 951 communicates with the CPU circuit unit 900 provided in the image forming apparatus 10 via a communication integrated circuit (IC) (not illustrated) to perform exchange of data such as job information and a sheet transfer notification, and execute various programs stored in the ROM 953 to perform drive control of the finisher 500.

Various types of inputs and outputs provided in the finisher 500 will be described. The finisher 500 includes an inlet motor M1, the buffer motor M2, the sheet discharge motor M3, the shift motor M5, the solenoids SL1 and SL2, and the conveyance path sensors 570 to 576, which drive the conveyance roller pairs 511 to 513 to convey the sheet. The finisher 500 includes the bundle discharge motor M4 for driving the bundle discharge roller pair 680 and alignment motors M6 and M7 for driving an alignment member 641 as a way for driving various members in the processing tray 630.

Further, the finisher 500 includes the tray elevating motors M14 and M15 for elevating the stacking trays 700 and 701, the sheet surface detection sensors 720 and 721, and the stacked-sheet detection sensors 740 and 741. The finisher 500 includes the upper tray alignment motors M8 and M9, the lower tray alignment motors M10 and M11, the upper tray alignment plate elevating motor M12, and the lower tray alignment plate elevating motor M13 to perform alignment operations on the stacking trays 700 and 701. The finisher 500 includes the upper tray paddle motor M17, the lower tray paddle motor M18, an upper tray paddle elevating motor M19, and a lower tray paddle elevating motor M20.

The flow of the sheets in the finisher 500 will be described with reference to FIGS. 3, 8, 16A to 16C, and 17. When the user presses a "sheet selection" key 418 on the initial screen illustrated in FIG. 3 in the operation display device 400 in the image forming apparatus 10, a sheet cassette selection screen, as illustrated in FIG. 17, is displayed on the display unit 420. The user selects sheets to be used for a job. FIG. 17 illustrates display when an "A4" size is selected as an example.

Figure 16A:
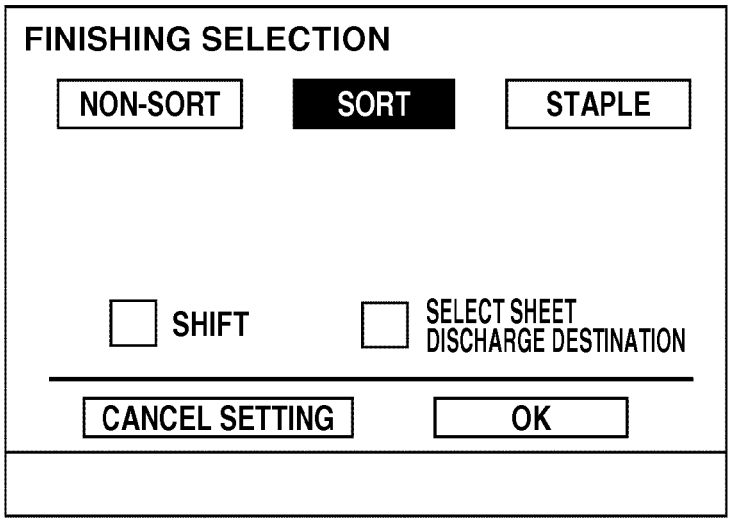
FIGS. 16A to 16C illustrate selection of a post-processing mode.
Figure 16B:
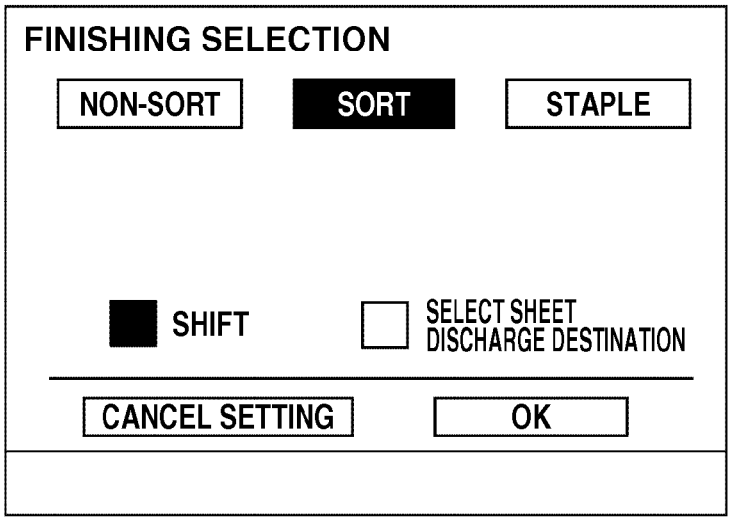
Figure 17:
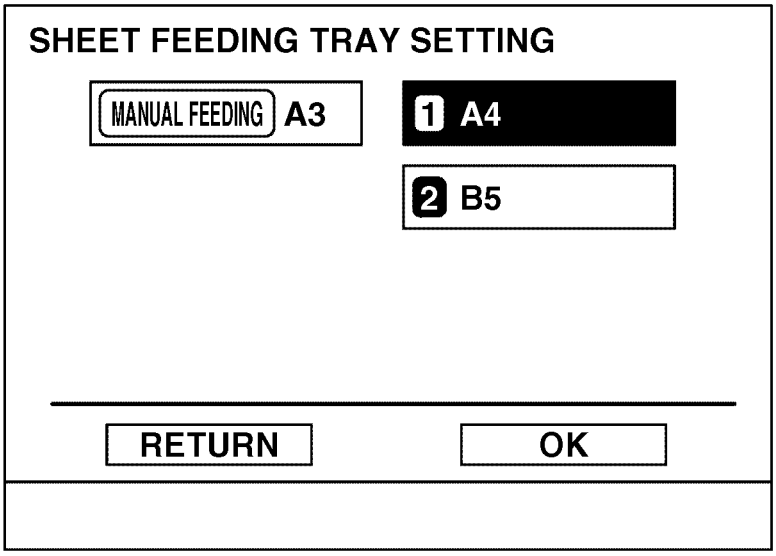
FIG. 17 illustrates sheet selection.

When the user selects the "finishing" key 417 on the initial screen illustrated in FIG. 3 in the operation display device 400 in the image forming apparatus 10, a finishing menu selection screen as illustrated in FIG. 16A is displayed on the display unit 420. When the user presses an OK key after selecting a "sort" key on the screen illustrated in FIG. 16A, a sort mode is set. When the user presses the OK key after selecting the "sort" key and a "shift" key as illustrated in FIG. 16B, a shift sort mode is set.

The sort mode is a mode in which sheets are sorted for each set of a copy constituting a document to perform image formation and are stacked onto the stacking tray in the image forming apparatus 10. The shift sort mode is a mode in which sheets are stacked while being offset from the center of the stacking tray in the sheet width direction for each set of a copy in the finisher 500. In the sort mode in which no shift is designated, sheets in each set of a copy are not offset and are stacked so that the center of the stacking tray and the center of the sheets in the sheet width direction match each other.

Figure 16C:
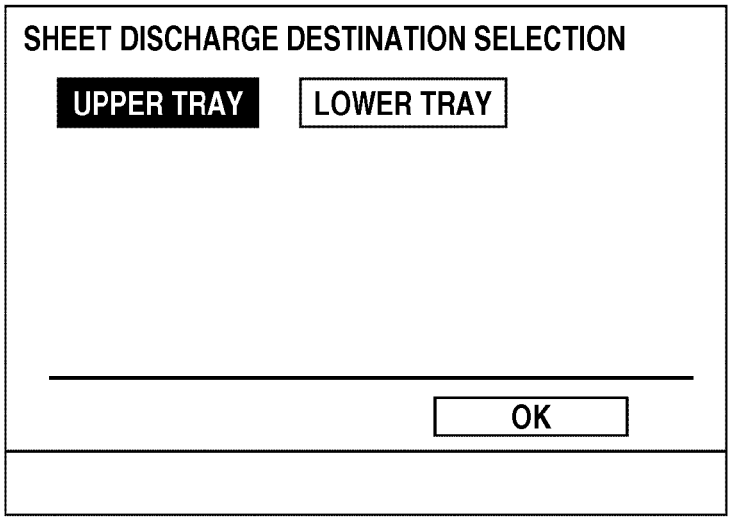

On a sheet discharge destination selection screen illustrated in FIG. 16C, the user can select the stacking tray onto which sheets are to be discharged. A case where the user selects an "upper tray" key will be described.

When a job in which the shift sort mode is designated is input, the CPU 901 in the CPU circuit unit 900 notifies the CPU 952 in the finisher control unit 951 of information relating to the job, e.g., a size, a grammage, and a shift direction and a discharge destination of the sheet, for each of the sheets. When the sheet is discharged from the image forming apparatus 10 to the finisher 500, the CPU 901 in the CPU circuit unit 900 notifies the CPU 952 in the finisher control unit 951 that transfer of the sheet is started.

Figure 8:
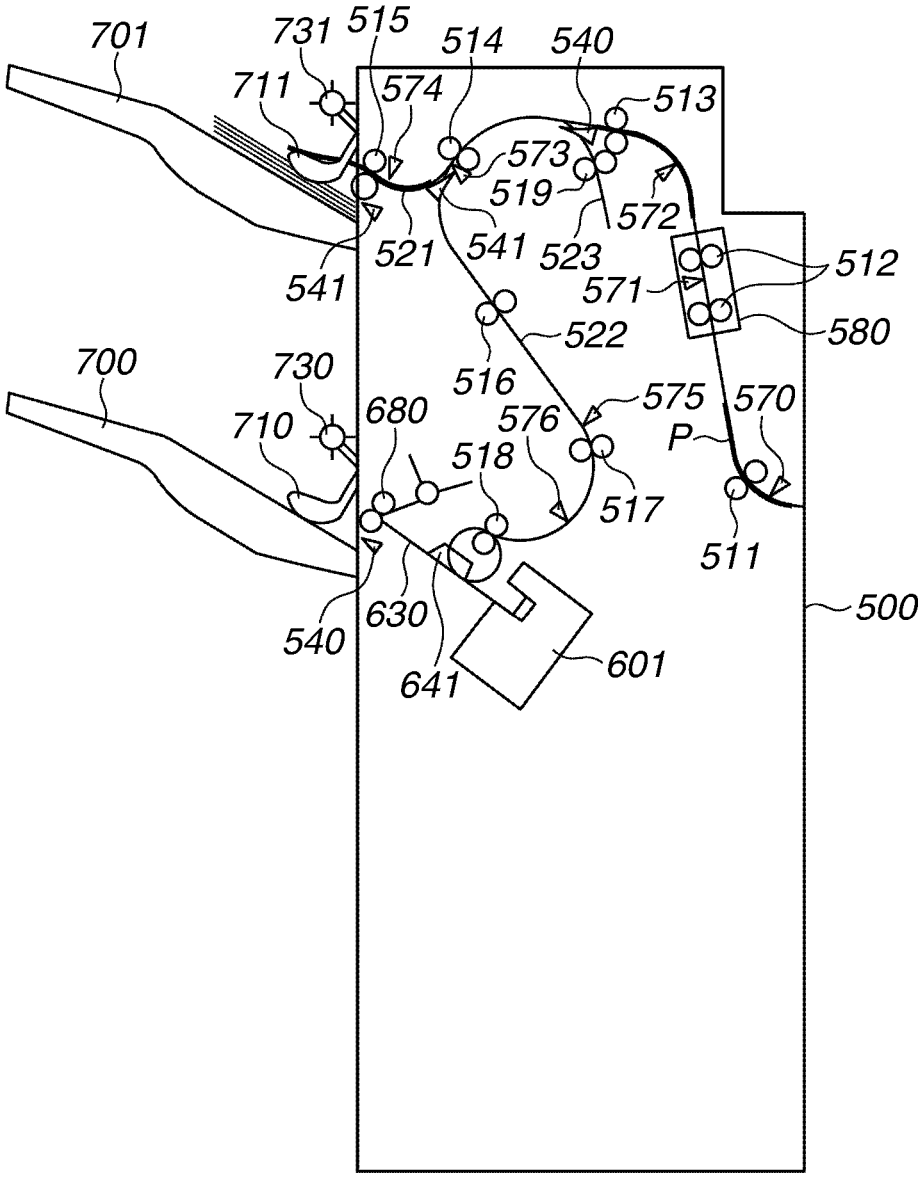
FIG. 8 illustrates sheet conveyance.

The CPU 952, which has received the notification that the transfer of the sheet is started, drives the inlet motor M1, the buffer motor M2, and the sheet discharge motor M3. Thus, the conveyance roller pairs 511, 512, 513, 514, and 515 are driven to rotate, and a sheet P discharged from the image forming apparatus 10 is taken in the finisher 500 and is conveyed, as illustrated in FIG. 8. When the conveyance path sensor 571 detects that the sheet P has been conveyed to a position where the conveyance roller pair 512 pinches the sheet P, the shift unit 580 shifts and conveys the sheet P in the sheet width direction. The sheet P is offset by 15 mm forward and by 15 mm backward from the center in the sheet width direction, respectively, if shift information of the sheet P notified from the CPU 901 is "front" and if the shift information is "back". If no shift is required, the sheet P is conveyed without being shifted.

If the stacking tray 701 (the upper tray) is selected as a sheet discharge destination, the CPU 952 drives the solenoid SL2 so that the switching flapper 541 guides the sheet P to the upper discharge path 521. When the conveyance path sensor 574 detects the passage of a trailing edge of the sheet P, the CPU 952 rotates the sheet discharge motor M3 at a speed suitable for stacking, and causes the conveyance roller pair 515 to discharge the sheet P onto the stacking tray 701.

When the stacking tray 700 (the lower tray) is selected as the sheet discharge destination, the CPU 952 drives the solenoid SL2 so that the switching flapper 541 guides the sheet P to the lower discharge path 522. When the conveyance path sensor 576 detects the passage of the trailing edge of the sheet P, the CPU 952 rotates the bundle discharge motor M4 at a speed suitable for stacking, and causes the bundle discharge roller pair 680 to discharge the sheet P onto the stacking tray 700.

Figure 9A:
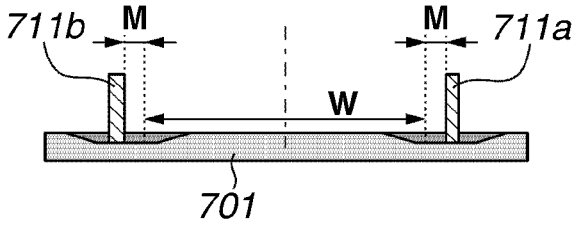
FIGS. 9A to 9D illustrate alignment when no shift is performed.

An alignment operation in the absence of a shift will be described with reference to FIGS. 9A to 9D. FIGS. 9A to 9D are cross-sectional views illustrating the stacking tray 701 as viewed from the sheet discharge direction. An alternate long and short dash line in FIGS. 9A to 9D represents a center position of the stacking tray 701 in the sheet width direction. When a sheet P having a width of W is discharged, the alignment plate 711*a* and the alignment plate 711*b* respectively wait at alignment standby positions each spaced apart from the center position of the stacking tray 701 by a length W/2, which is half the sheet width W, plus an alignment plate retraction amount M, as illustrated in FIG. 9A.

Figure 9C:
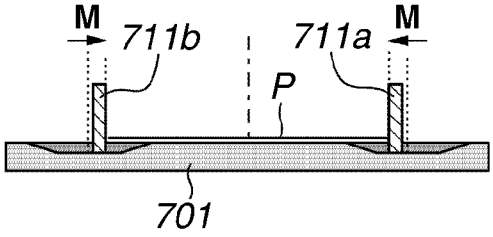
Figure 9B:
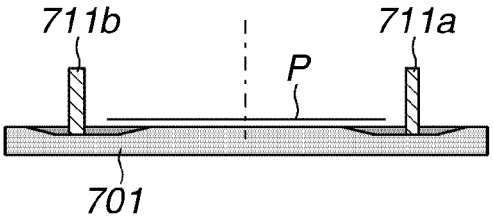
Figure 9D:
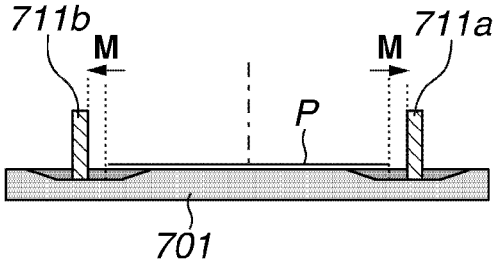

When a predetermined period of time has elapsed since the sheet P was discharged onto the stacking tray 701, as illustrated in FIG. 9B, the alignment plate 711*a* and the alignment plate 711*b* move by the alignment plate retraction amount M toward the center of the stacking tray 701 to align the sheet P in such a manner as to put the sheet P therebetween, as illustrated in FIG. 9C. When the predetermined period of time has then elapsed, the alignment plate 711*a* and the alignment plate 711*b* move outward by the alignment plate retraction amount M, as illustrated in FIG. 9D, to prepare for receiving the succeeding sheet. The foregoing operation is repeated so that sheets are aligned every time they are discharged one at a time onto the stacking tray 701.

An alignment operation in the presence of a shift will be described with reference to FIGS. 10A to 10I. A case where a shift direction is changed from the front side (the right side in the figures) to the back side (the left side in the figures) will be described. FIGS. 10A to 10I are cross-sectional views of the stacking tray 701 as viewed from the position A illustrated in FIG. 4. An alternate long and short dash line in the figures represents a center position of the stacking tray 701 in the sheet width direction.

Figure 10A:
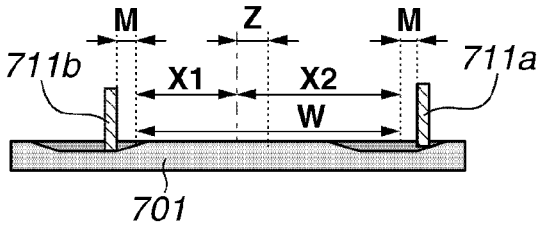
FIGS. 10A to 10I illustrate alignment when a shift is performed.

As illustrated in FIG. 10A, the alignment plate 711*a* moves to an alignment standby position spaced apart from the center of the stacking tray 701 by a distance X2, which is the length W/2 plus an offset amount Z, plus a retraction amount M. Similarly, the alignment plate 711*b* moves to an alignment standby position spaced apart from the center of the stacking tray 701 by a distance X1, which is the length W/2 minus the offset amount Z, plus the retraction amount M.

Figure 10B:
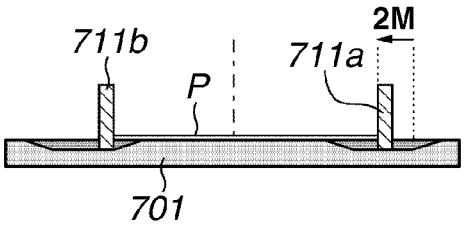
Figure 10C:
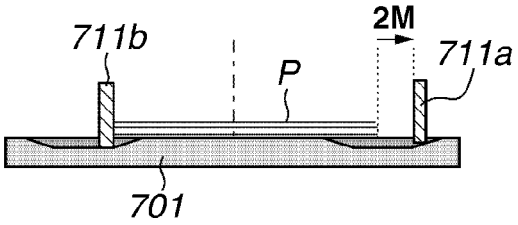
Figure 10D:
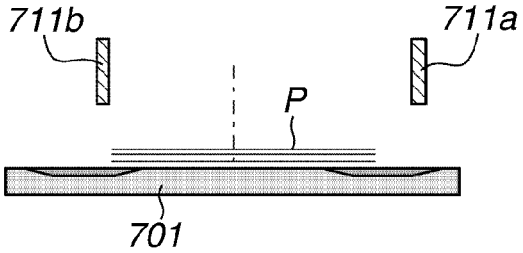

When the sheet P is then discharged, as illustrated in FIG. 10B, the alignment plate 711*a* moves toward the center of the stacking tray 701 by a distance that is two times the retraction amount M, and causes the sheet P to abut on the alignment plate 711*b*, to align the sheet P. After the above-described alignment operation ends, the alignment plate 711*a* moves to the alignment standby position spaced the distance 2M apart therefrom in an opposite direction to the center of the stacking tray 701, as illustrated in FIG. 10C. The alignment operation is then similarly performed every time one sheet is discharged. When all sheets in the first set of the copy have been aligned, the alignment plates 711*a* and 711*b* are spaced a predetermined amount apart upward from the stacking tray 701, as illustrated in FIG. 10D.

Figure 10E:
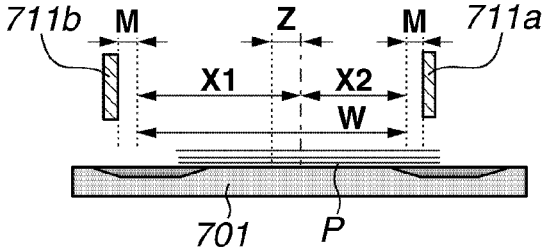

The alignment plates 711*a* and 711*b* then respectively move to the alignment standby positions in the succeeding set of the copy, as illustrated in FIG. 10E. More specifically, the alignment plate 711*a* moves to a position spaced apart from the center of the stacking tray 701 by the distance X2, which is the length W/2 plus the offset amount Z, plus the retraction amount M. Similarly, the alignment plate 711*b* moves to the alignment standby position spaced apart from the center of the stacking tray 701 by the distance X1, which is the length W/2 minus the offset amount Z, plus the retraction amount M.

Figure 10F:
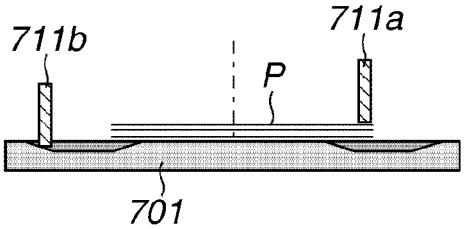

When the alignment plate 711*a* and the alignment plate 711*b* finish moving, the alignment plates 711*a* and 711*b* are respectively lowered by the predetermined amounts toward the stacking tray 701, as illustrated in FIG. 10F. In a state where the alignment plates 711*a* and 711*b* remain stopped until the succeeding sheet is discharged onto the stacking tray 701, the alignment plate 711*a* contacts an upper surface of the already stacked sheet. Therefore, a lowered amount of the alignment plate 711*a* is smaller than that of the alignment plate 711*b*.

Figure 10G:
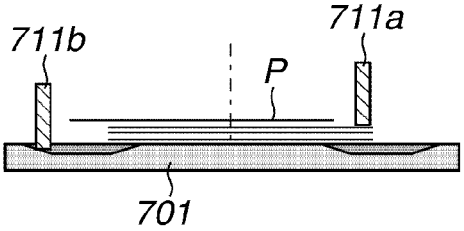
Figure 10H:
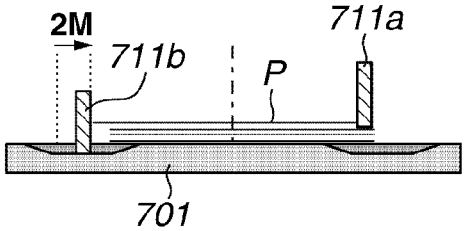
Figure 10I:
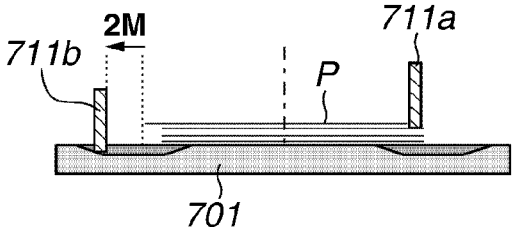
Figure 11:
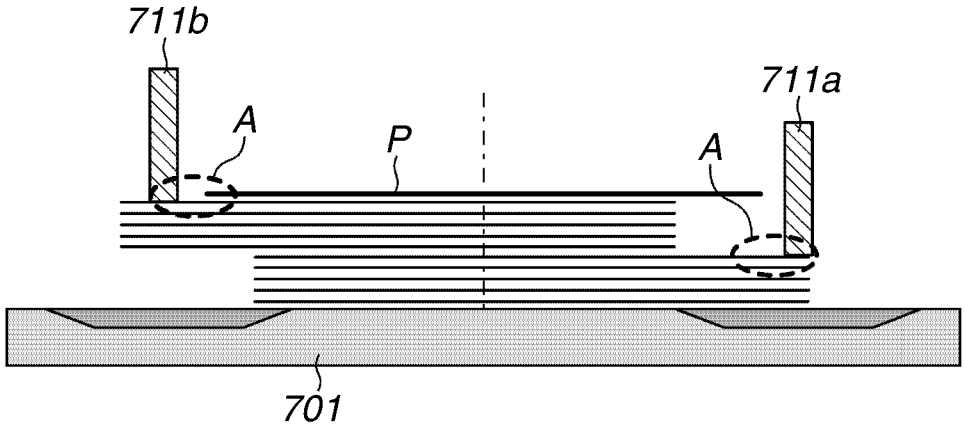
FIG. 11 illustrates a condition under which a sheet is damaged during alignment.

When a predetermined period of time has elapsed since a sheet in the succeeding set of the copy was discharged onto the stacking tray 701, as illustrated in FIG. 10G, the alignment plate 711*b* moves toward the center of the stacking tray 701 by a distance 2M that is two times the retraction amount M, as illustrated in FIG. 10H, and causes the sheet to abut on the alignment plate 711*a* to align the sheet. When a predetermined period of time has elapsed since the alignment plate 711*a* abutted on the sheet P, the alignment plate 711*b* moves to the alignment standby position spaced the distance 2M apart therefrom in an opposite direction to the center of the stacking tray 701, as illustrated in FIG. 10I, and remains stopped until the succeeding sheet is discharged onto the stacking tray 701.

If the shift direction is changed, as described above, the alignment plate is spaced apart upward from the stacking tray 701 once, and lowered after changing the alignment position in the sheet width direction to align the sheet.

Figure 14:
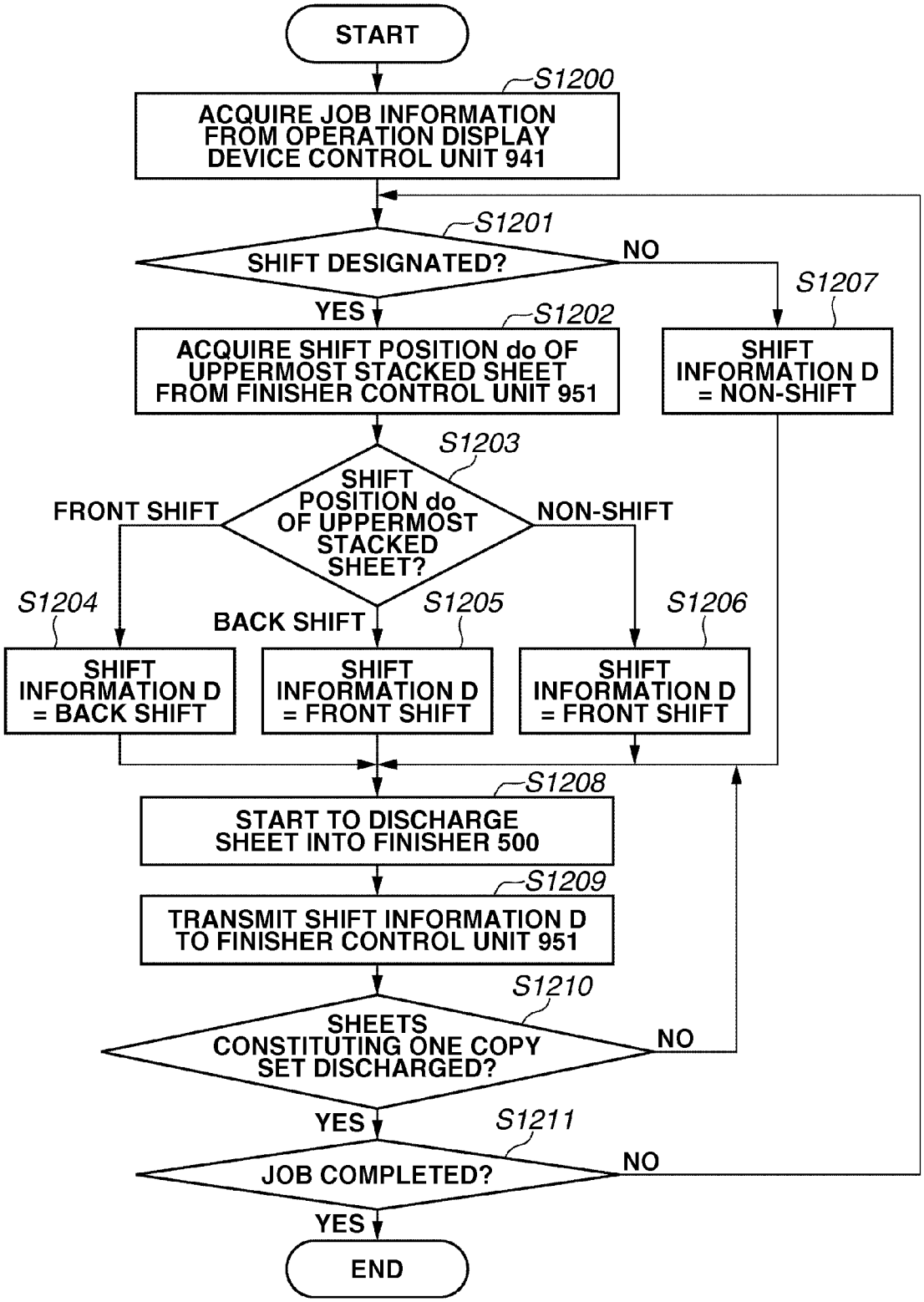
FIG. 14 is a flowchart illustrating shift information notification processing.

Processing for notifying shift information D from the CPU circuit unit 900 to the finisher control unit 951, illustrated in FIG. 2, will be described with reference to a flowchart in FIG. 14. The CPU 901 executes the processing in the flowchart illustrated in FIG. 14.

In step S1200, the CPU 901 acquires job information input by a user, such as the presence or absence of a shift, the number of sheets constituting a set of the copy, and the number of sets of the copy from the operation display device control unit 941. In step S1201, the CPU 901 determines the presence or absence of a shift from the job information acquired in step S1200. If the shift is designated (YES in step S1201), the processing proceeds to step S1202. If the shift is not designated (NO in step S1201), the processing proceeds to step S1207.

In step S1202, the CPU 901 acquires a shift position do to which the finisher 500 has shifted a sheet in the preceding job or the preceding set of the copy from the finisher control unit 951 via a communication IC (not illustrated). The processing then proceeds to step S1203.

In step S1203, the CPU 901 determines the shift position do acquired in step S1202. If the shift position do represents a front shift in step S1203, the processing proceeds to step S1204. In step S1204, the CPU 901 sets the shift information D to a back shift. The processing then proceeds to step S1208. If the shift position do represents a back shift in step S1203, the processing proceeds to step S1205. In step S1205, the CPU 901 sets the shift information D to a front shift. The processing then proceeds to step S1208. If the shift position do represents a non-shift in step S1203, the processing proceeds to step S1206. In step S1206, the CPU 901 sets the shift information D to a front shift. The processing then proceeds to step S1208.

On the other hand, if the shift is not designated (NO in step S1201), then in step S1207, the CPU 901 sets the shift information D to a non-shift. The processing then proceeds to step S1208.

In step S1208, the CPU 901 starts to discharge one sheet to the finisher 500. The processing then proceeds to step S1209. In step S1209, the CPU 901 transmits the shift information D to the finisher control unit 951. The processing then proceeds to step S1210.

In step S1210, the CPU 901 determines whether sheets constituting a set of a copy have been discharged to the finisher 500 based on the job information acquired in step S1200. If the sheets constituting the set of the copy have not been discharged (NO in step S1210), the processing returns to step S1208. The processing in step S1208 and the subsequent steps is repeated until the sheets constituting the set of the copy are discharged to the finisher 500.

If the sheets constituting the set of the copy have been discharged to the finisher 500 (YES in step S1210), the processing proceeds to step S1211. In step S1211, the CPU 901 determines whether the job is completed. If the job is not completed (NO in step S1211), the processing returns to step S1201. The processing in step S1201 and the subsequent steps is repeated. If the job is completed (YES in step S1211), the shift information notification processing ends.

A shift operation will be described with reference to a flowchart in FIG. 12 and tables in FIGS. 15A to 15C. FIG. 12 is a flowchart illustrating a shift operation performed on a single sheet by a control program stored in the ROM 953 by the CPU 952. FIGS. 15A to 15C are tables for shift positions d determined by the processing in the flowchart in FIG. 12. A shift operation for a sheet to be discharged onto the stacking tray 701 and a shift operation for a sheet to be discharged onto the stacking tray 700 are the same. Therefore, the shift operation of the sheet to be discharged onto the stacking tray 701 will be described.

In step S1000, the CPU 952 acquires shift information D of a conveyance sheet from the CPU circuit unit 900 via a communication IC (not illustrated). The processing then proceeds to step S1001. In step S1001, the CPU 952 determines whether the conveyance path sensor 571 has detected the sheet. If the conveyance path sensor 571 has not detected the sheet (NO in step S1001), the CPU 952 waits until the conveyance path sensor 571 detects the sheet.

If the conveyance path sensor 571 has detected the sheet (YES in step S1001), the processing proceeds to step S1002.

In step S1002, the CPU 952 determines a content of the shift information D of the conveyance sheet acquired in step S1000. If the shift information D represents a front shift in step S1002, the processing proceeds to step S1003. In step S1003, the CPU 952 drives the shift motor M5 to rotate forward to move the shift unit 580 to the front side and shift the sheet by 15 mm to the front side from the center of the stacking tray 701. In step S1004, the CPU 952 then substitutes information representing the front shift into the shift position d serving as information representing a position to which the sheet has been actually shifted, and the processing proceeds to step S1021.

If the shift information D represents a back shift in step S1002, the processing proceeds to step S1005. In step S1005, the CPU 952 drives the shift motor M5 to rotate backward to move the shift unit 580 to the back side and shift the sheet by 15 mm to the back side from the center of the stacking tray 701. In step S1006, the CPU 952 then substitutes information representing the back shift into the shift position d, and the processing proceeds to step S1021.

If the shift information D represents a non-shift in step S1002, the processing proceeds to step S1007. In step S1007, the CPU 952 determines whether the stacked-sheet detection sensor 741 is turned on and shift information D0 of the preceding sheet includes information.

If the stacked-sheet detection sensor 741 is not turned on or the shift information D0 of the preceding sheet includes no information (NO in step S1007), the processing proceeds to step S1008. In step S1008, the CPU 952 substitutes information representing a non-shift into the shift position d, and the processing proceeds to step S1021. If the first sheet is discharged after power to the image forming system is turned on, for example, the shift information D0 of the preceding sheet includes no information. In such a case, if a sheet is remained on the stacking tray 701 since before the power was turned on, the stacked-sheet detection sensor 741 is turned on, and the shift information D0 includes no information.

If the stacked-sheet detection sensor 741 is turned on and the shift information D0 of the preceding sheet includes information (YES in step S1007), the processing proceeds to step S1009. In step S1009, the CPU 952 determines whether the shift information D0 of the preceding sheet represents the non-shift.

If the shift information D0 represents the non-shift (YES in step S1009), the processing proceeds to step S1010. In step S1010, the CPU 952 determines processing to be performed next according to the shift position do of the preceding sheet.

If the shift position do of the preceding sheet represents the front shift, the processing proceeds to step S1011. In step S1011, the CPU 952 drives the shift motor M5 to rotate forward to shift the sheet to the front side. In step S1012, the CPU 952 then substitutes information representing the front shift into the shift position d, and the processing proceeds to step S1021.

If the shift position do of the preceding sheet represents the back shift in step S1010, the processing proceeds to step S1013. In step S1013, the CPU 952 drives the shift motor M5 to rotate backward to shift the sheet to the back side. In step S1014, the CPU 952 then substitutes information representing the back shift into the shift position d, and the processing proceeds to step S1021.

If the shift position do of the preceding sheet represents the non-shift in step S1010, the CPU 952 conveys the sheet without shifting the sheet, and the processing proceeds to step S1015. In step S1015, the CPU 952 substitutes information representing the non-shift into the shift position d, and the processing proceeds to step S1021.

If the shift information D0 does not represent the non-shift (NO in step S1009), the processing proceeds to step S1016. In step S1016, the CPU 952 determines whether the shift position do of the preceding sheet represents the front shift.

If the shift position do of the preceding sheet represents the front shift (YES in step S1016), the processing proceeds to step S1017. In step S1017, the CPU 952 drives the shift motor M5 to rotate backward to shift the sheet to the back side. In step S1018, the CPU 952 then substitutes information representing the back shift into the shift position d, and the processing proceeds to step S1021.

If the shift position do of the preceding sheet does not represent the front shift (NO in step S1016), the processing proceeds to step S1019. In step S1019, the CPU 952 drives the shift motor M5 to rotate forward to shift the sheet to the front side. In step S1020, the CPU 952 then substitutes information representing the front shift into the shift position d, and the processing proceeds to step S1021.

In the above-described manner, the sheet discharge position in the sheet width direction includes three positions, that is a first position (the front shift), a second position (the back shift), and a third position (the non-shift). Even if the third position is designated as the shift information D, the shift position d is determined to be the second position if the sheet discharge position of sheets in the preceding set of the copy is the first position, and is determined to be the first position if the discharge position of sheets in the preceding set of the copy is the second position. For the sheets in the same set of the copy, the shift position d is the same as the shift position do of the preceding sheet.

In step S1021, the CPU 952 waits until the conveyance path sensor 571 is turned off, in other words, a trailing edge of the sheet passes through the conveyance path sensor 571. If the conveyance path sensor 571 is turned off (YES in step S1021), the processing proceeds to step S1022. In step S1022, the CPU 952 determines processing to be performed next according to the shift position d.

If the shift position d represents the front shift in step S1022, the processing proceeds to step S1023. In step S1023, the CPU 952 drives the shift motor M5 to rotate backward to move the shift unit 580 from a front shift position to a center position. The processing proceeds to step S1025.

If the shift position d represents the back shift in step S1022, the CPU 952 drives the shift motor M5 to rotate forward to move the shift unit 580 from a back shift position to the center position. The processing proceeds to step S1025.

If the shift position d represents the non-shift in step S1022, the processing proceeds to step S1025.

In step S1025, the CPU 952 performs alignment processing described below. In step S1026, the CPU 952 then substitutes the shift information D and the shift position d, respectively, into shift information D0 and a shift position do. In step S1027, the CPU 952 stores the shift position do and the shift information D0 in the RAM 954, and the shift operation ends.

According to the above-described control, if the shift information D represents the front shift or the back shift, the sheet is shifted to positions designated by the shift information D, respectively, as illustrated in FIGS. 15B and 15C. Even if the shift information D represents the non-shift, the sheet is shifted to a position illustrated in FIG. 15A. Therefore, if sheets in the preceding job are offset discharged onto the stacking tray 701, sheets in a job in which no shift is designated are offset discharged not onto the center of the stacking tray 701 but in an opposite direction to an offset direction of the sheets in the preceding job.

The alignment processing in step S1025 in the flowchart in FIG. 12 will be described with reference to a flowchart in FIG.

Figure 13:
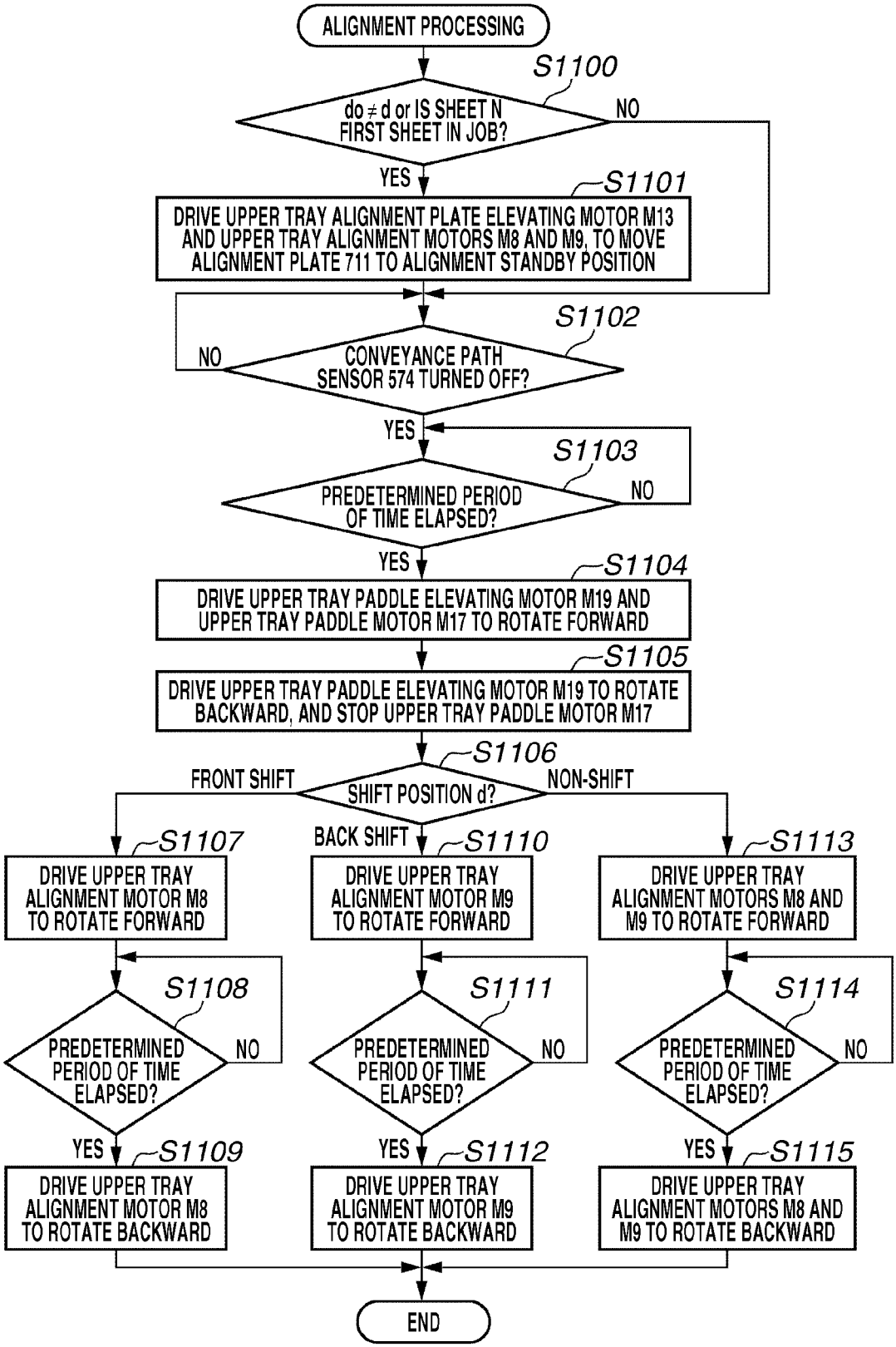
FIG. 13 is a flowchart illustrating an alignment processing operation.

13 and operations of the alignment plates 711*a* and 711*b* illustrated in FIGS. 9A to 9D and FIGS. 10A to 10I. The CPU 952 executes the processing in the flowchart illustrated in FIG. 13.

In the following description, a sheet to be discharged onto the stacking tray 701 is a sheet N, and the preceding sheet is a sheet N−1. In step S1100, the CPU 952 determines whether the sheet N is a first sheet in a job or a shift position d of the sheet N and a shift position do of the preceding sheet N−1 differ from each other from sheet information of the sheet N acquired from the CPU circuit unit 900 via a communication IC (not illustrated).

If the sheet N is the first sheet in the job or the shift position d of the sheet N and the shift position do of the preceding sheet N−1 differ from each other (YES in step S1100), the processing proceeds to step S1101. If the sheet N is not the first sheet in the job and the shift position d of the sheet N and the shift position do of the preceding sheet N−1 do not differ from each other (NO in step S1100), the processing proceeds to step S1102.

In step S1101, the CPU 952 drives the upper tray alignment plate elevating motor M13 and the upper tray alignment motors M8 and M9 to move the alignment plate 711 to a position corresponding to the shift position d. The position corresponding to the shift position d is the alignment standby position illustrated in FIGS. 9 and 10. The processing then proceeds to step S1102.

In step S1102, the CPU 952 determines whether the conveyance path sensor 574 is turned off. If the conveyance path sensor 574 is not turned off (NO in step S1102), the CPU 952 waits until the conveyance path sensor 574 is turned off, in other words, a trailing edge of the sheet N passes through the conveyance path sensor 574. If the conveyance path sensor 574 is turned off (YES in step S1102), the processing proceeds to step S1103. In step S1103, the CPU 952 determines whether a predetermined period of time has elapsed since the conveyance path sensor 574 was turned off.

If the predetermined period of time has elapsed (YES in step S1103), the processing proceeds to step S1104. In step S1104, the CPU 952 drives the upper tray paddle elevating motor M19 and the upper tray paddle motor M17 to rotate forward to move the alignment paddle 731 to the sheet return position illustrated in FIG. 7A. The sheet discharged onto the stacking tray 701 is returned in a direction opposite to the sheet discharge direction by this operation. The processing then proceeds to step S1105.

In step S1105, the CPU 952 drives the upper tray paddle motor M19 to rotate backward to move the alignment paddle 731 to the retracted position illustrated in FIG. 7B. In addition, the CPU 952 stops the upper tray paddle motor M17. The processing then proceeds to step S1106.

In step S1106, the CPU 952 determines processing to be performed next according to the content of the shift position d. If the shift position d represents the front shift in step S1106, the processing proceeds to step S1107. If the shift position d represents the back shift in step S1106, the processing proceeds to step S1110. If the shift position d represents the non-shift in step S1106, the processing proceeds to step S1113.

In step S1107, the CPU 952 drives the upper tray alignment motor M8 to rotate forward to move the alignment plate 711*a* to a position illustrated in FIG. 10B and cause the alignment plate 711*a* to abut on the sheet to align the sheet. In step S1108, the CPU 952 then waits until a predetermined period of time has elapsed since the alignment plate 711*a* abutted on the sheet. If the predetermined period of time has elapsed (YES in step S1108), the processing proceeds to step S1109.

In step S1109, the CPU 952 drives the upper tray alignment motor M8 to rotate backward to move the alignment plate 711*a* to a position illustrated in FIG. 10C. Thus, the alignment operation corresponding to a single sheet ends.

In step S1110, the CPU 952 drives the upper tray alignment motor M9 to rotate forward to move the alignment plate 711*b* to a position illustrated in FIG. 10H and cause the alignment plate 711*b* to abut on the sheet to align the sheet. In step S1111, the CPU 952 then waits until a predetermined period of time has elapsed since the alignment plate 711*b* abutted on the sheet. If the predetermined period of time has elapsed (YES in step S1111), the processing proceeds to step S1112. In step S1112, the CPU 952 drives the upper tray alignment motor M9 to rotate backward to move the alignment plate 711*b* to a position illustrated in FIG. 10I. Thus, the alignment operation corresponding to a single sheet ends.

In step S1113, the CPU 952 drives the upper tray alignment motors M8 and M9 to rotate forward to move the alignment plates 711*a* and 711*b* to positions illustrated in FIG. 9C and cause the alignment plates 711*a* and 711*b* to abut on the sheet to align the sheet. In step S1114, the CPU 952 then waits until a predetermined period of time has elapsed since the alignment plates 711*a* and 711*b* abutted on the sheet. If the predetermined period of time has elapsed (YES in step S1114), the processing proceeds to step S1115. In step S1115, the CPU 952 drives the upper tray alignment motors M8 and M9 to rotate backward to move the alignment plates 711*a* and 711*b* to the positions illustrated in FIG. 9D. Thus, the alignment operation corresponding to a single sheet ends.

According to the present exemplary embodiment, the alignment plates 711*a* and 711*b* can be prevented from moving in the sheet width direction while contacting an upper surface of the already stacked sheets on the stacking tray 701. Therefore, the already stacked sheets can be prevented from being damaged by scratches or dirt.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-172861 filed Aug. 8, 2011, which is hereby incorporated by reference herein in its entirety.

What is claimed is:

1. A sheet stacking apparatus comprising:

a discharge unit configured to discharge a sheet to be conveyed;

a stacking tray configured to stack the sheet discharged by the discharge unit;

an acquisition unit configured to acquire shift information for designating a stacking position of the sheet in a sheet width direction which is orthogonal to a sheet conveyance direction to sort a set of a copy;

a shift control unit configured to control, in response to the shift information acquired by the acquisition unit representing stacking in a first position, the stacking position of the sheet in the sheet width direction so that the sheet is stacked in the first position, to control, in response to the shift information representing stacking in a second position, the stacking position of the sheet in the sheet width direction so that the sheet is stacked in the second position, and to control, in response to the shift information representing neither the first position nor the second position and the sheet not being stacked on the stacking tray, the stacking position of the sheet in the sheet width direction so that the sheet is stacked in a third position between the first position and the second position; and an alignment unit configured to align the sheet staked on the stacking tray, wherein the alignment unit moves to a position corresponding to the stacking position of the sheet controlled by the shift control unit and abuts on a side edge of the sheet in the sheet width direction to align the sheet, wherein, in response to a first sheet being stacked on the first position and shift information of a second sheet, which is subsequent to the first sheet, not indicating either the first position or the second position, the shift control unit controls a stacking position of the second sheet to stack the second sheet on the second position, and, in response to the first sheet being stacked on the second position and the shift information of the second sheet not indicating either the first position or the second position, the shift control unit controls the stacking position of the second sheet to stack the second sheet on the first position.

2. The sheet stacking apparatus according to claim 1, wherein the first sheet is included in a first set of a copy, and the second sheet is included in a second set of a copy which is different from the first set of the copy.

3. The sheet stacking apparatus according to claim 1, wherein in response to the first sheet being stacked on the third position and the shift information of the second sheet, which is subsequent to the first sheet, not indicating either the first position or the second position, the shift control unit controls the stacking position of the second sheet to stack the second sheet on the third position.

4. The sheet stacking apparatus according to claim 1, wherein the first position and the second position are respectively offset in different directions from a conveyance center position in the sheet width direction, and the third position is the conveyance center position.

5. The sheet stacking apparatus according to claim 1, wherein the alignment unit includes first and second alignment members that move in the sheet width direction and, in response to the second sheet being stacked in the second position with the first sheet stacked in the first position, the alignment unit moves the second alignment member so that the first alignment member abuts on an upper surface of the first sheet while stopping thereon and the second alignment member abuts on a side edge of the second sheet.

6. The sheet stacking apparatus according to claim 1, wherein the acquisition unit acquires the shift information from an image forming apparatus that conveys a sheet to the sheet stacking apparatus.

7. The sheet stacking apparatus according to claim 1, wherein the shift control unit includes a storage unit configured to store, for each sheet, the shift information and a position where the sheet is stacked on the stacking tray.

8. An image forming apparatus comprising:

an image forming unit configured to form an image on a sheet;

a discharge unit configured to discharge the sheet on which the image is formed by the image forming unit;

a stacking tray configured to stack the sheet discharged by the discharge unit;

an acquisition unit configured to acquire shift information for designating a stacking position of the sheet in a sheet width direction which is orthogonal to a sheet conveyance direction to sort a set of a copy;

a shift control unit configured to control, in response to the shift information acquired by the acquisition unit representing stacking in a first position, the stacking position of the sheet in the sheet width direction so that the sheet is stacked in the first position, to control, in response to the shift information representing stacking in a second position, the stacking position of the sheet in the sheet width direction so that the sheet is stacked in the second position, and to control, in response to the shift information representing neither the first position nor the second position and the sheet not being stacked on the stacking tray, the stacking position of the sheet in the sheet width direction so that the sheet is stacked in a third position between the first position and the second position; and an alignment unit configured to align the sheet staked on the stacking tray, wherein the alignment unit moves to a position corresponding to the stacking position of the sheet controlled by the shift control unit and abuts on a side edge of the sheet in the sheet width direction to align the sheet, wherein, in response to a first sheet being stacked on the first position and shift information of a second sheet, which is subsequent to the first sheet, not indicating either the first position or the second position, the shift control unit controls a stacking position of the second sheet to stack the second sheet on the second position, and in response to the first sheet being stacked on the second position and the shift information of the second sheet not indicating either the first position or the second position, the shift control unit controls the stacking position of the second sheet to stack the second sheet on the first position.

* * * * *